United States Patent [19]

Nishikawa et al.

[11] 4,142,791

[45] Mar. 6, 1979

[54] ELECTROGRAPHIC APPARATUS HAVING A SCREEN-TYPE PHOTOCONDUCTIVE DRUM

[75] Inventors: Masaji Nishikawa; Muneo Kasuga, both of Hachioji, Japan

[73] Assignee: Olympus Optical Company Limited, Tokyo, Japan

[21] Appl. No.: 800,906

[22] Filed: May 26, 1977

[30] Foreign Application Priority Data

Jun. 7, 1976 [JP] Japan ..... 51/65524

[51] Int. Cl.[2] ..... G03G 15/00

[52] U.S. Cl. ..... 355/3 SC; 355/3 CH

[58] Field of Search ..... 355/3 R, 3 DR, 3 SC, 355/3 CH, 3 TE

[56] References Cited

U.S. PATENT DOCUMENTS

| | | | |
|---|---|---|---|
| 3,985,432 | 10/1976 | Hou et al. | 355/3 SC |
| 4,040,731 | 8/1977 | Nishikawa | 355/3 SC |
| 4,046,466 | 9/1977 | Ando et al. | 355/3 SC |

OTHER PUBLICATIONS

Noto; Fedele A; "Copier with Single Corona Generating Device," Xerox Disclosure Journal, Feb. 1976, vol. 1, No. 2, p. 93.

*Primary Examiner*—Fred L. Braun

*Attorney, Agent, or Firm*—Haseltine, Lake & Waters

[57] ABSTRACT

An electrographic apparatus which makes use of a screen drum composed of a mesh-shaped photosensitive screen. The apparatus comprises one corona discharge device, a corona voltage source circuit including a corona voltage source switch connected to an input side of said corona voltage source circuit and a polarity change-over switch connected between said corona voltage source circuit and said corona discharge device. A first step of uniformly charging said photosensitive screen and a second step of charging a dielectric coated record sheet with an electrostatic charge image corresponding to an image to be recorded are effected by one corona discharge device only.

6 Claims, 5 Drawing Figures

ELECTROGRAPHIC APPARATUS HAVING A SCREEN-TYPE PHOTOCONDUCTIVE DRUM

This invention relates to an electrographic apparatus which makes use of a screen drum composed of a mesh-shaped photosensitive screen.

Heretofore, it has been the common practice to modulate a flow of corona ions by means of an electrostatic latent image produced on a photosensitive screen and produce an electrostatic charge image corresponding to a manuscript to be recorded on a dielectric coated record sheet. A conventional electrographic apparatus which makes use of a photosensitive screen consisting of four layers can control a first step of uniformly charging the photosensitive screen by means of a first corona discharge device and a second step of producing the electrostatic charge image on the dielectric coated record sheet by means of a second corona discharge device with the aid of a bias voltage applied to the photosensitive screen. Such conventional electrographic apparatus is highly valuable in practice.

In such electrographic apparatus, it has been proposed to use a screen drum composed of a mesh-shaped photosensitive screen. Such conventional electrographic apparatus also makes use of two corona discharge devices for the purpose of effecting the first and second corona charging steps, so that the apparatus is complex in construction, not reliable in operation and expensive.

An object of the invention, therefore, is to provide an electrographic apparatus which makes use of a screen drum composed of a mesh-shaped photosensitive screen, which can effect the above described first and second charging steps with the aid of only one corona discharge device and which is simple in construction, reliable in operation and less expensive.

A feature of the invention is the provision of an electrographic apparatus comprising a screen drum composed of a mesh-shaped photosensitive screen formed of at least a photoconductive layer and an electrically conductive layer superimposed one upon the other, one corona discharge device arranged in said screen drum, a mechanism for feeding a dielectric coated record sheet arranged at the outside of said screen drum and opposed to said corona discharge device, a corona voltage source circuit, a polarity change-over switch connected between said corona voltage source circuit and said corona discharge device and, during a first turn of said screen drum, applying a voltage having a first polarity is applied therethrough to said corona discharge device so as to effect a first step of charging said screen drum from the side of said electrically conductive layer and to effect a step of exposing said screen drum to a light image corresponding to a manuscript to be recorded, and during a second and following turns of said screen drum, applying a voltage having a second polarity therethrough to said corona discharge device so as to effect a second step of charging said sceen drum from the side of said electrically conductive layer, with a dielectric coated record sheet located near the side of said photoconductive layer of said screen drum, and a corona voltage source switch connected to an input side of said corona voltage source circuit and for opening and closing an output voltage circuit of said corona voltage source circuit, said corona voltage source switch being operatively interlocked with said polarity change-over switch such that said corona voltage source switch is open when said polarity change-over switch is changed over so as to prevent spark discharge from occuring when said polarity change-over switch is changed over.

The invention will now be described in greater detail with reference to the accompanying drawings, wherein.

Figure 1A:
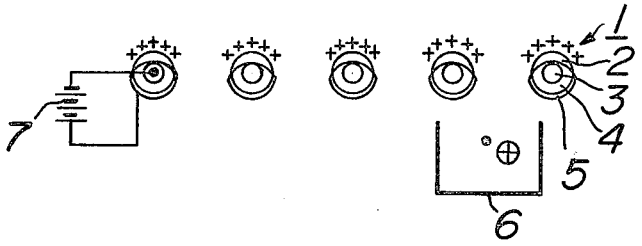
FIG. 1A PRIOR ART
FIG. 1A is a cross sectional view of a photosensitive screen illustrating a first step of uniformly charging it with the aid of a first corona discharge device.
Figure 1B:
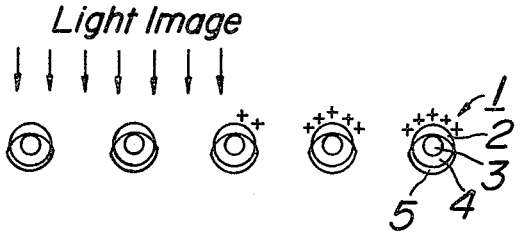
FIG. 1B PRIOR ART
FIG. 1B is a similar cross sectional view illustrating a step of exposing the photosensitive screen shown in FIG. 1A to a light image corresponding to a manuscript to be recorded.
Figure 1C:
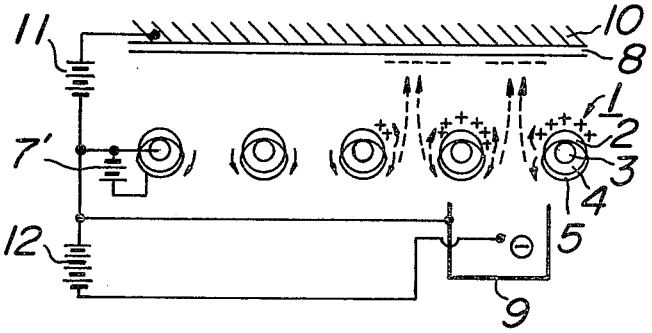
FIG. 1C PRIOR ART
FIG. 1C is a cross sectional view of a photosensitive screen and a dielectric coated record sheet illustrating a second step of producing an electrostatic charge on the dielectric coated record sheet with the aid of a second corona discharge device.

FIGS. 1A to 1C show a conventional electrographic apparatus which makes use of a photosensitive screen 1. The photosensitive screen 1 consists of an electrically conductive core 3 which is coated on one side with a photoconductive layer 2 and coated on the other side with an insulating layer 4 and an electrically conductive layer 5 superimposed one upon the other. The photoconductive layer 2 is formed of selenium.

In FIG. 1A is shown a first step of positively and uniformly charging the photosensitive screen 1 from the side of the electrically conductive layer 5 by means of a first corona discharge device 6. The first corona charging step from the side of the electrically conductive layer 5 causes the surface of the photoconductive layer 2 to be charged with a voltage which is substantially the same as the voltage applied from a bias voltage source 7 connected beforehand across the electrically conductive core 3 and the electrically conductive layer 5.

In FIG. 1B is shown a step of exposing the surface of the photoconductive layer 2 uniformly charged by the first charging step shown in FIG. 1A to a light image corresponding to an image to be recorded. In the light image projecting step shown in FIG. 1B, that portion of the photoconductive layer 2 which is exposed to the light image becomes locally conductive to lose its surface electric charge. That portion of the photoconductive layer 2 which is dark functions to maintain its surface electric charge. As a result, an electrostatic latent image is formed on the photosensitive screen 1.

In FIG. 1C is shown a second step of charging an electrostatic charge image on a dielectric coated record sheet 8 on the basis of the electrostatic latent image formed on the photosensitive screen 1 by the light image projecting step shown in FIG. 1B. In the second charging step shown in FIG. 1C, the dielectric coated record sheet 8 is opposed through the photosensitive screen 1 to a second corona discharge device 9. The second corona discharge device 9 functions to negatively charge the photosensitive screen 1, i.e. charge it with a polarity which is opposite to the polarity of the first charging from the side of the electrically conductive layer 5. In the rear of the dielectric coated record sheet 8 which is opposed to the second corona discharge device 9 is arranged a field electrode 10. Between the field electrode 10 and the electrically conductive core 3 of the photosensitive screen 1 is connected a bias voltage source 11 so as to accelerate the flow of corona ions directed from the second corona discharge device 9 toward the photosensitive screen 1. In the second charging step shown in FIG. 1C, a value of the voltage supplied from a bias voltage source 7' and biassing the photosensitive screen 1 is made smaller than the voltage for biassing the photosensitive screen 1 at both the first charging step shown in FIG. 1A and the light image projecting step shown in FIG. 1B. The voltage applied to the photosensitive screen 1 from the bias voltage source 7' is selected such that the portion of the photosensitive screen 1 which is dark causes the flow of corona ions to pass therethrough and that portion of the photosensitive screen 1 which is exposed to the light image causes the flow of corona ions to be blocked.

As a result, at the imagewise dark portion the accelerating electric field produced between the electrically conductive core 3 and the surface of the photoconductive layer 2 becomes stronger than the blocking electric field, so that the flow of corona ions is effectively directed through the photosensitive screen 1 toward the dielectric coated record sheet 8 which is then formed with the electrostatic charge image. Reference numeral 12 designates a corona voltage source.

In order to make the above described electrographic apparatus small in size and less expensive, an electrographic apparatus which makes use of a screen drum composed of a mesh-shaped photosensitive screen has also been developed. Such conventional electrographic apparatus also utilizes two independent corona discharge device for the purpose of effecting the first and second charging steps and hence is complex in construction and expensive.

Figure 2:
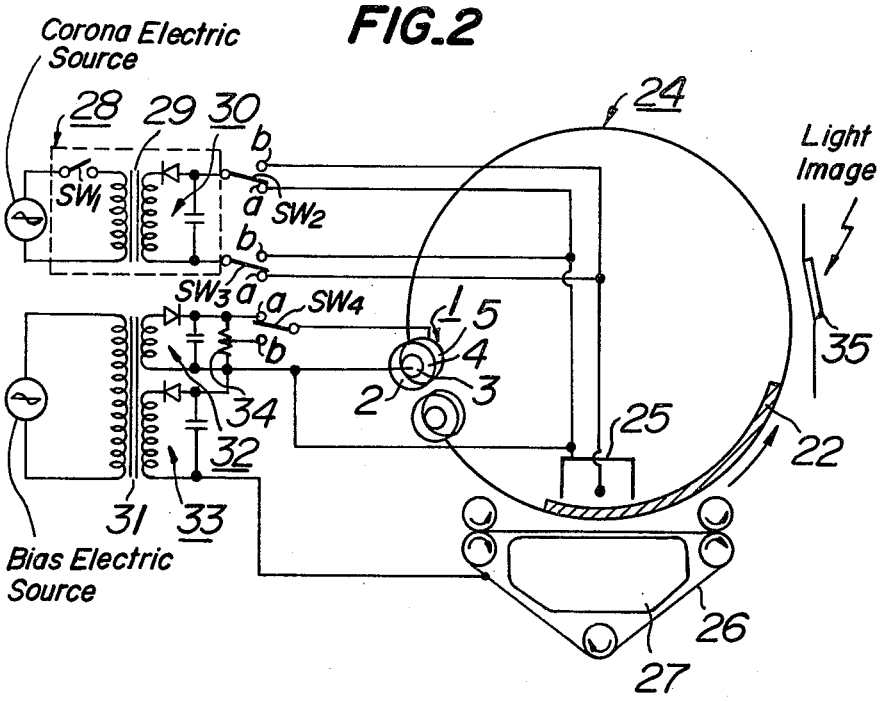
FIG. 2 is a cross sectional view of one embodiment of the electrographic apparatus according to the invention.
Figure 3:
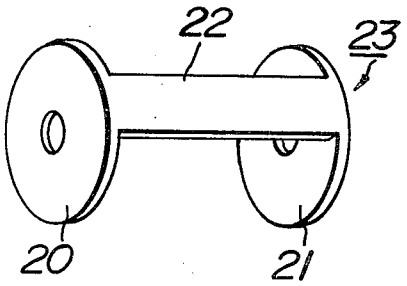
FIG. 3 is a perspective view of a supporting frame for supporting a screen drum shown in FIG. 2.

In FIG. 2 is shown one embodiment of the electrographic apparatus according to the invention for practicing the electrographic process described with reference to FIGS. 1A and 1C. An electrically conductive core 3 is coated on one side with a photoconductive layer 2 and coated on the other side with an insulating layer 4 and an electrically conductive layer 5 superimposed one upon the other to provide a mesh-shaped photosensitive screen 1. The photosensitive screen 1 is wound around a drum-shaped frame 23 formed of a pair of discs 20, 21 spaced apart from each other and made integral with a supporting plate 22 connected across the discs 20, 21 to form a screen drum 24. The photosensitive screen 1 is arranged such that its photoconductive layer 2 is faced toward the outside of the screen drum 24.

In the inside of the screen drum 24 is arranged one corona discharge device 25 and at the outside of the screen drum 24 is arranged a record sheet feeding mechanism which is opposed to the corona discharge device 25. The record sheet feeding mechanism is composed of a conveyor belt 26 for feeding a record sheet (not shown) at a given speed and costituting a field electrode. In the conveyor belt 26 is arranged a vacuum suction box 27 which functions to efficiently hold the record sheet on the conveyor belt 26.

To the corona discharge device 25 is applied a desired voltage from a corona voltage source circuit 28. The corona voltage source circuit 28 is composed of transformer 29 having a primary winding connected through a corona voltage source switch $SW_1$ to an alternating current main line and a secondary winding connected across a rectifier smoothing circuit 30. The corona voltage source switch $SW_1$ is operatively interlocked with the screen drum 24 such that when the screen drum 24 is rotated in a direction shown by an arrow and the supporting plate 22 arrives at that position which is opposed to the corona discharge device 25, the corona voltage source switch $SW_1$ becomes open and that when the screen portion of the screen drum 24 arrives at that position which is opposed to the corona discharge device 25, the corona voltage source switch $SW_1$ is closed. To conductors connecting two output terminals of the rectification smoothing circuit 30 to a shield electrode and a corona discharge wire of the corona discharge device 25 are connected polarity change-over switches $SW_2$ and $SW_3$, respctively. These polarity change-over switches $SW_2$ and $SW_3$ are operatively interlocked with the corona voltage source switch $SW_1$ such that when the switch $SW_1$ becomes open both the polarity change-over switches $SW_2$ and $SW_3$ close respective contacts a, a or b, b.

A bias voltage source circuit for applying a bias voltage across the electrically conductive core 3 and the electrically conductive layer 5 of the photosensitive screen 1 of the screen drum 24 and also applying a voltage across the electrically conductive core 3 of the screen drum 24 and the conveyor belt 26 constituting the field electrode are composed of a transformer 31 having a primary winding directly connected across terminals of an alternating current main line and two secondary windings connected across rectification smoothing circuits 32 and 33, respectively.

As described with reference to FIGS. 1A and 1C, in order to make the screen bias voltage value at the first charging step different from the screen bias voltage value at the second charging step, a voltage divider 34 is connected in parallel with the rectification smoothing circuit 32 connected across the electrically conductive core 3 and the electrically conductive layer 5 of the screen drum 24. Provision is also made of a change-over switch $SW_4$ having a change-over arm connected to the electrically conductive layer 5 of the photosensitive screen 1 and adapted to be connected either a contact a connected to a positive output terminals of the rectification smoothing circuit 32 or a contact b connected to a slidable arm of the voltage divider 34. Negative output terminals of the rectification smoothing circuits 32 and 33 connected across the secondary winding of the transformer 31 are connected in common to the shield electrode of the corona discharge device 25. The change-over switch $SW_4$ is operatively interlocked with both the polarity change-over switches $SW_2$ and $SW_3$.

In the above described electrographic apparatus according to the invention, in the first charging step shown in FIG. 1A, the switch $SW_1$ is made open and the change-over switches $SW_2$ and $SW_3$ are connected to the contacts a, a as shown in FIG. 2, respectively. Then, the screen drum 24 is rotated by one turn in a direction shown by an arrow and a manuscript (not shown) is scanned by a light in synchronism with the peripheral speed of the screen drum 24 and a light image reflected back from the manuscript is projected through a transparent window 35 arranged near the outer periphery of the screen drum 24 thereon. In this case, at intervals of time at which the screen portion of the screen drum 24 is opposed to the corona discharge device 25, the corona voltage source switch $SW_1$ is closed to apply a voltage having a first charging polarity to the corona discharge device 25. In this way, the first charging step shown in FIG. 1A and the light image projecting step shown in FIG. 1B are effected.

Then, the corona voltage source switch $SW_1$ is made open and the change-over switches $SW_2$, $SW_3$ and $SW_4$ are changed over and connected to the contacts b, b, b, respectively. At the same time, a dielectric coated record sheet, for example, an electrostatic record sheet is placed on the conveyor belt 26 and the screen drum 24 is rotated by a further one turn. In this case, the supporting plate 22 of the screen drum 24 passes through the corona discharge device 25. At the intervals of time at which the supporting plate 22 of the screen drum 24 passes through the corona discharge device 25, the corona voltage source switch $SW_1$ is made open. At the intervals of time at which the corona voltage source switch $SW_1$ is open, the change-over switches $SW_2$, $SW_3$ and $SW_4$ are changed over and connected to the contacts b, b, b, respectively. When the screen portion of the screen drum 24 becomes opposed to the corona discharge device 25, the corona voltage source switch $SW_1$ is closed to supply a second polarity voltage to the corona discharge device 25. In this way, the second charging step described with reference to FIG. 1C is effected to form an electrostatic charge image on the electrostatic record sheet. This electrostatic charge image is toned by colored toner particles to provide a final record sheet.

In the electrographic apparatus in general, a number of copies are required to be obtained from one manuscript. The above mentioned electrostatic latent image on the screen drum 24 is effectively maintained even after the second charging step. As a result, if the screen drum 24 is further rotated and at the same time the electrostatic record sheet is placed on the conveyor belt 26 so as to continue the second charging step only, it is possible to obtain a desired number of copies.

After the copying operation, the residual electrostatic latent image may be erased from the photosensitive screen 1 by applying an alternating current while exposing the total surface of the photosensitive screen 1 to light or by applying a corona voltage whose polarity is opposite to that of the electric charge on the outer periphery of the screen drum 24 while exposing the total surface of the photosensitive screen 1 to light and by shortcircuiting the electrically conductive core 3 with the electrically conductive layer 5 applied with the screen bias voltage. In the former case, after the copying operation, the corona voltage source switch $SW_1$ is made open and the contact arms of the change-over switches $SW_2$, $SW_3$, $SW_4$ are connected to the contacts a, a, a, respectively, so as to make ready for the next copying operation. Under such condition, the residual electrostatic latent image is erased from the photosensitive screen 1 by supplying the alternating current thereto.

In the latter case, the contact arms of the change-over switches $SW_2$, $SW_3$ are connected to the contacts b, b, respectively, so as to apply the voltage whose polarity is the same as that of the corona ions at the second charging step to the corona discharge device 25. Under such condition, the residual electrostatic latent image is erased from the photosensitive screen 1. Then, the corona voltage source switch $SW_1$ is made open and the contact arms of the change-over switches $SW_2$, $SW_3$, $SW_4$ are connected to the contacts a, a, a, respectively, to make ready for the next copying operation.

In the above described first and second charging steps, the opening and closing operations of the corona voltage source switch $SW_1$ and the change-over operations of the change-over switches $SW_2$, $SW_3$ and $SW_4$ must be synchronized with the rotation of the screen drum 24, that is, must be effected at the intervals of time at which the supporting plate 22 of the screen drum 24 is opposed to the corona discharge device 25. For this purpose, for example, the disc 20 or 21 of the screen drum 24 is provided at its end surface with projections spaced apart from each other. These projections are operatively associated with a microswitch arranged near these projections such that a signal delivered by closing the microswitch with the aid of the projections causes the corona voltage source switch $SW_1$ to open when the supporting plate 22 is opposed to the corona discharge device 25 and causes the change-over switches $SW_2$, $SW_3$, $SW_4$ to connect respective contact arms to the contacts b, b, b, respectively, at substantially midpoint of the time of intervals at which the switch $SW_1$ is open.

In the case of obtaining desired number of copies, a signal derived from a select switch for selecting the desired number of copies is combined with the signal delivered from the above mentioned microswitch such that the switch $SW_1$ and the change-over switches $SW_2$, $SW_3$ and $SW_4$ are not operated by the signal delivered from the microswitch until the desired number of copies are obtained.

As stated hereinbefore, the electrographic apparatus according to the invention has the advantage that the first and second charging steps can be effected by only one corona discharge device so that the maintenance of the corona discharge device arranged in the rotatable screen drum and the corona voltage source circuit can significantly be simplified and become less expensive, and that at the time of changing-over operation of the change-over switches these switches are not subjected to the high voltage from the corona voltage source so that there is no risk of the spark discharge being occurred and hence it is possible to make considerably long the life of the change-over switches and significantly improve the reliability thereof.

The invention is not limited to the above described embodiment and many changes, alternations and modifications may be made. For example, in the above embodiment, the photosensitive screen was of a construction formed of four layers. But, use may also be made of a photosensitive screen including at least photoconductive layer and electrically conductive layer.

In this case, the corona voltage source circuit may be changed in construction and arrangement in response to the photosensitive screen employed. For example, if use is made of a photosensitive screen composed of three layers consisting of an electrically conductive layer, photoconductive layer and insulating layer, the screen bias is not necessary, so that the screen bias voltage source circuit may be omitted.

What is claimed is:

1. An electrographic apparatus comprising a screen drum composed of a mesh-shaped photosensitive screen formed of at least photoconductive layer and an electrically conductive layer superimposed one upon the other, one corona discharge device arranged in said screen drum, a mechanism for feeding a dielectric coated record sheet arranged at the outside of said screen drum and opposed to said corona discharge device, a corona voltage source circuit, a polarity change-over switch connected between said corona voltage source circuit and said corona discharge device and, during a first turn of said screen drum, applying a voltage having a first polarity therethrough to said corona discharge device so as to effect a first step of charging said screen drum from the side of said electrically conductive layer, and to effect a step of exposing said screen drum to a light image corresponding to a manuscript to be recorded, and during a second and following turns of said screen drum, applying a voltage having a second polarity therethrough to said corona discharge device so as to effect a second step of charging said screen drum from the side of said electrically conductive layer, with a dielectric coated record sheet located near the side of said photoconductive layer of said screen drum, and a corona voltage source switch connected to an input side of said corona voltage source circuit and for opening and closing an output voltage circuit of said corona voltage source circuit, said corona voltage source switch being operatively interlocked with said polarity change-over switch such that said corona voltage source switch is open when said polarity change-over switch is changed over so as to prevent spark discharge from occurring when said polarity change-over switch is changed over.

2. The electrographic apparatus according to claim 1 wherein said screen drum is supported by a supporting frame composed of a pair of discs and a supporting plate each end of which is connected to one position of the periphery of said disc and both the change-over operation of said polarity change-over switch and the opening and closing operation of said corona voltage source switch are effected when said supporting plate arrives at a position opposed to said corona discharge device.

3. The electrographic apparatus according to claim 1 wherein said corona voltage source circuit is composed of a transformer having a primary winding connected through said corona voltage source switch to an alternating current main line and a secondary winding connected through a rectifier smoothing circuit and said polarity change-over switch to said corona discharge device.

4. The electrographic apparatus according to claim 3 wherein two of said polarity change-over switches are connected to conductors connecting two output terminals of said rectifier smoothing circuit to a shield electrode and a corona discharge wire of said corona discharge device, respectively.

5. The electrographic apparatus according to claim 1 and comprising further a bias voltage source circuit for applying a bias voltage across an electrically conductive core and said electrically conductive layer of said photosensitive screen and also applying a voltage across said electrically conductive core and a conveyor belt constituting a field electrode, said bias voltage source being composed of a transformer having a primary winding connected to an alternating current main line and two secondary windings one of which is connected through a rectifier smoothing circuit and another polarity change-over switch to said photosensitive screen and the other secondary winding is connected through a rectifier smoothing circuit to said corona discharge device and to said conveyor belt.

6. The electrographic apparatus according to claim 5 wherein said rectifier smoothing circuit connected across one of said two secondary windings and connected to said another polarity change-over switch includes a voltage divider connected in parallel with said rectifier smoothing circuit and having a slidable arm connected to one of the contacts of said another polarity change-over switch.

* * * * *